US007611386B1

(12) United States Patent
Zhang et al.

(10) Patent No.: US 7,611,386 B1
(45) Date of Patent: Nov. 3, 2009

(54) ELECTRICAL CONNECTOR WITH POWER CONTACTS DESIGNED TO HANDLE INSTANTANEOUS INRUSH CURRENT

(75) Inventors: George (Huanyi) Zhang, Irvine, CA (US); Gustavo F. Duenas, Placentia, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/157,780

(22) Filed: Jun. 12, 2008

(51) Int. Cl.
*H01R 24/00* (2006.01)

(52) U.S. Cl. ..... 439/660; 439/924.1

(58) Field of Classification Search ..... 439/660, 439/924.1, 108, 101
See application file for complete search history.

(56) References Cited

U.S. PATENT DOCUMENTS 4,867,690 A * 9/1989 Thumma ..... 439/924.1
4,985,870 A * 1/1991 Faraci ..... 439/924.1
5,432,916 A * 7/1995 Hahn et al. ..... 439/924.1
6,309,255 B1 * 10/2001 Yu ..... 439/660
7,097,507 B1 * 8/2006 Zhang et al. ..... 439/607.35
7,255,607 B1 8/2007 Wu

* cited by examiner

*Primary Examiner*—Tho D Ta
(74) *Attorney, Agent, or Firm*—Wei Te Chung; Andrew C. Cheng; Ming Chieh Chang

(57) ABSTRACT

An electrical connector (2) comprises an insulative housing including a mating tongue (20) exposed in a mating port (23), and three type contacts. The mating tongue has a front face (200) thereof. The three type contacts include two power contacts (201, 203) being on two opposite side regions of the mating tongue, three signal ground contacts (206) located between said two power contacts, and two pairs of signal contacts (205) each located between the corresponding two adjacent signal ground contacts. One of the two power contacts (201) extends much closer to the front face of the mating tongue than the other (203) of the two power contacts. This arrangement of two different-lengths has the ability to handle the instantaneous inrush current through the former power contact, i.e. the pre-charge power pin.

11 Claims, 4 Drawing Sheets

ELECTRICAL CONNECTOR WITH POWER CONTACTS DESIGNED TO HANDLE INSTANTANEOUS INRUSH CURRENT

BACKGROUND OF THE INVENTION

1. Field of the Invention

The present invention generally relates to an electrical connector, and more particularly to an electrical connector with power contacts designed to handle instantaneous inrush current.

2. Description of Related Art

Serial ATA connectors in accordance with Serial ATA specification are widely used in desktops currently for transmitting signals from motherboard to HDD or transmitting power from power supply of the computer to the HDD, or transmitting signals or power between outer HDD to the computer. When the Serial ATA connectors used in external applications, current designs usually are single connector comprising signal and grounding contacts for signal transmission or single connector comprising power contacts for voltage power transmission. However, in some applications, the connector transmitting signals needs to be combined with power transmission. Thus, an additional power connector is no longer needed. The actual status is that there is no such a connector complying with such demands.

Related connectors including power contacts can be found in U.S. Pat. No. 7,255,607 issued on Dec. 6, 2007, U.S. patent application Ser. No. 11/893,074 (which has been allowed by Examiner, but not yet issued), and U.S. patent application Ser. No. 11/998,771 (which is currently pending before USPTO), all of which are assigned to the same assignee as the current application. These power contacts have no ability to handle the instantaneous inrush or surge current through the power contacts.

BRIEF SUMMARY OF THE INVENTION

An electrical connector according to an embodiment of the present invention comprises an insulative housing including a mating tongue exposed in a mating port, and three type contacts. The mating tongue has a front face thereof. The three type contacts include two power contacts being on two opposite side regions of the mating tongue, three signal ground contacts located between the two power contacts, two pairs of signal contacts each located between the corresponding two adjacent signal ground contacts. One of the two power contacts extends much closer to the front face of the mating tongue than the other of the two power contacts. The arrangement of two different-lengths has the ability to handle the instantaneous inrush current through the former power contact, i.e. the pre-charge power pin.

Other objects, advantages and novel features of the invention will become more apparent from the following detailed description of the present embodiment when taken in conjunction with the accompanying drawings.

DETAILED DESCRIPTION OF THE INVENTION

Figure 1:
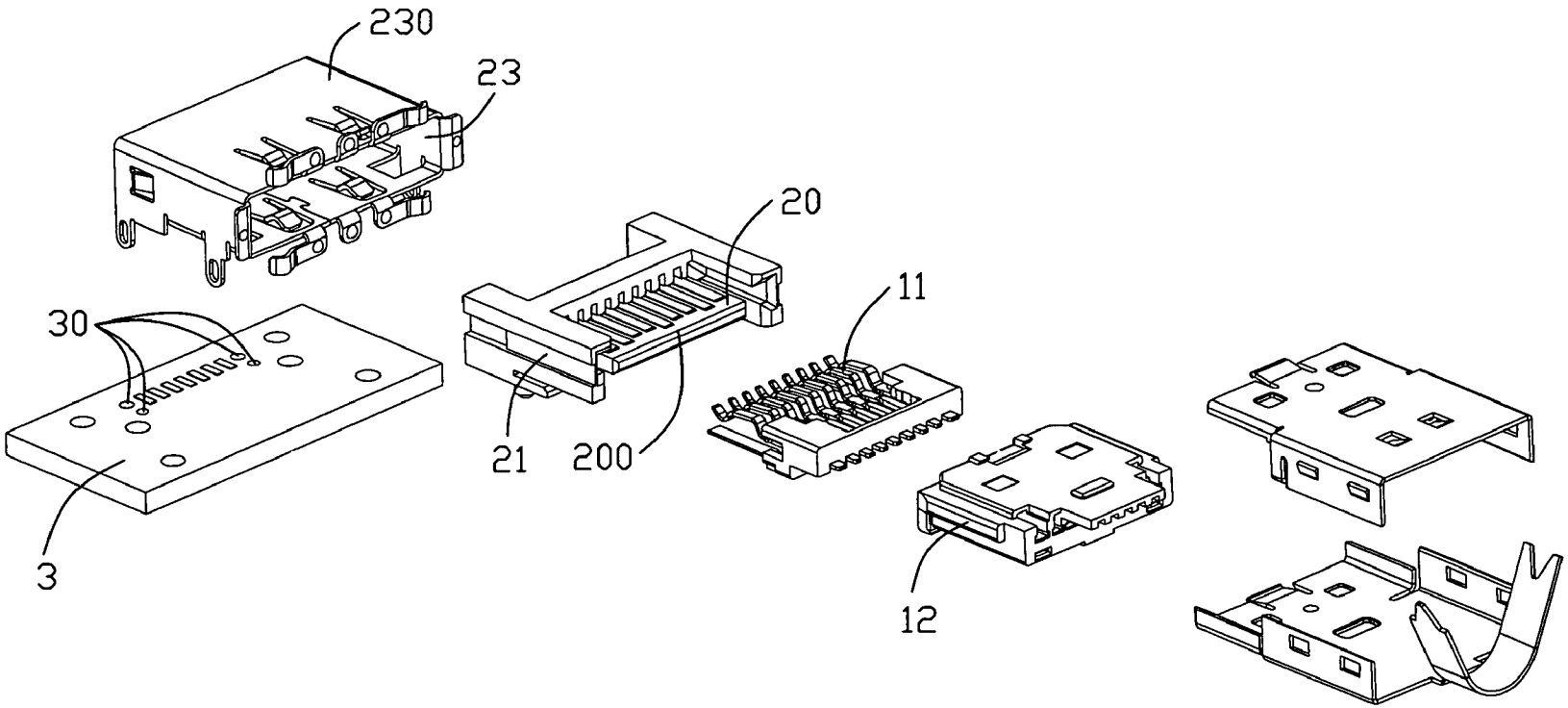
FIG. 1 is an exploded, perspective view of an electrical connector assembly in accordance with a preferred embodiment of the present invention.

Reference will now be made to the drawing figures to describe the present invention in detail.

Figure 2:
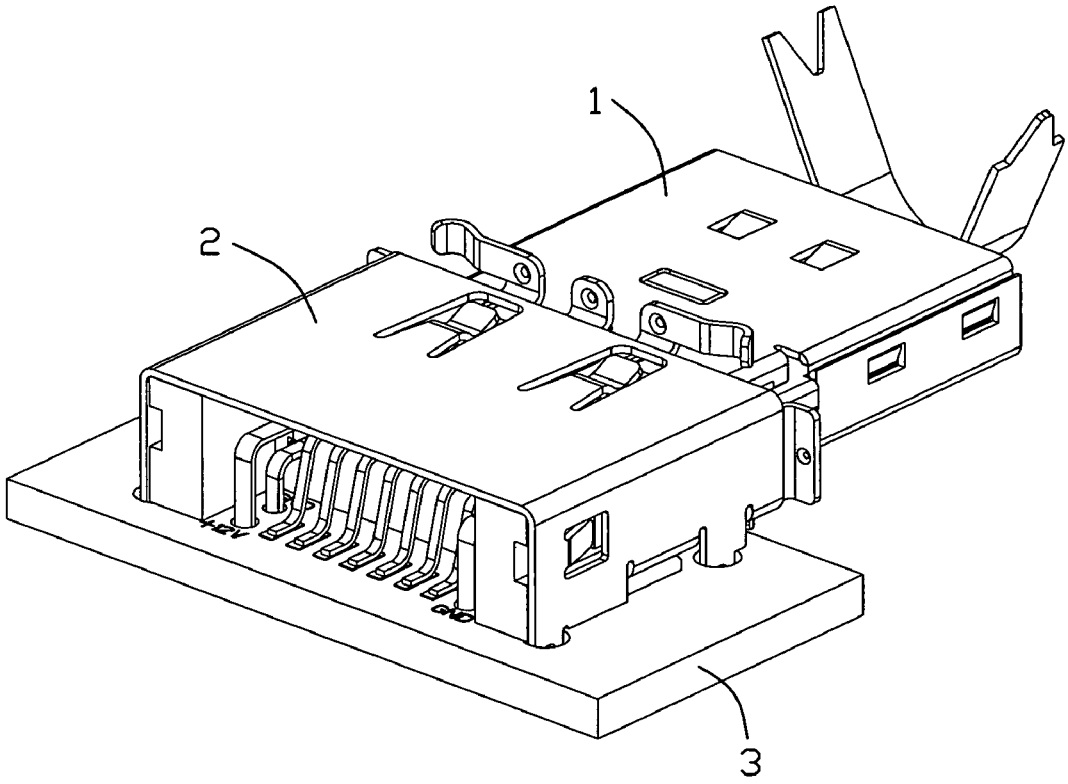
FIG. 2 is an assembled, perspective view of the electrical connector assembly of FIG. 1.
Figure 3:
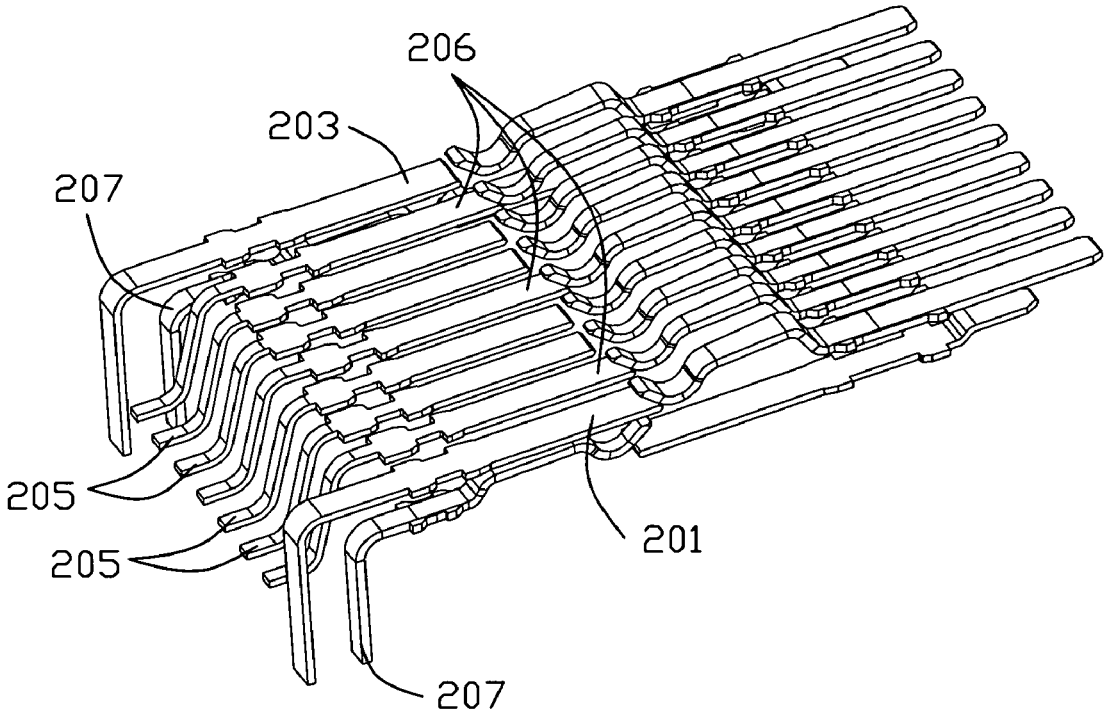
FIG. 3 is a perspective view showing two sets of contacts being at an initial mating position, the two sets of contacts respectively belonging to two mated electrical connectors of the electrical connector assembly of FIG. 1.
Figure 4:
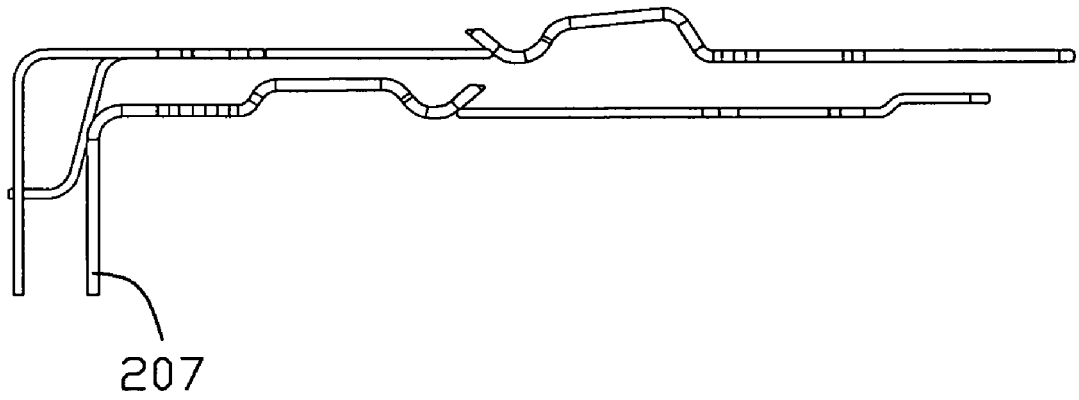
FIG. 4 is a side view of the two sets of contacts of FIG. 3.

Referring to FIGS. 1-2 in conjunction with FIGS. 3-4, an electrical connector assembly in accordance with an embodiment of the present invention includes a first connector 1 having an insulative body and a plurality of terminals 11 assembled onto the insulative body, and a second connector 2 for mating with the first connector 1. An insulative housing of the second connector 2 is designed to have two side guiding grooves 21 on opposite side walls thereof to engage two corresponding ribs 12 formed on the first connector 1 to guide insertion of the first connector 1 to achieve the mating function. In addition, the second connector 2 is mounted on a printed circuit board 3, which is provided with another four holes 30 for additional contacts, including two power contacts together with two power ground contacts, as described below.

The second connector 2, named as an e-SATA connector, includes the insulative housing having a mating tongue 20 exposed in a mating portion 23 defined by a shell 230 of the second connector 2. The shell 230 of the second e-SATA connector 2 is the same to that of a current SATA connector. The mating tongue 20 defines a front face 200 thereof. In this embodiment as shown in FIGS. 3-4, there are three type contacts commonly disposed on a same face of the mating tongue 20, including two pairs of signal contacts 205, three signal ground contacts 206 and two power contacts 201 and 203. This configuration changes no much of the structure of the current SATA connector but may alter dimension of a tongue of the current SATA connector. Two power contacts 201 and 203 are located on two opposite side regions of the mating tongue 20. The three signal ground contacts 206, for pairs of signal contacts 205 to ground, are located between the two power contacts 201 and 203, and the two pairs of signal contacts 205 each is located between the corresponding two adjacent signal ground contacts 206, with the two power contacts 201 and 203 being widest among the three type contacts. The three type contacts are symmetrically arranged with one another with regard to a middle signal ground contact 206. It should be noted that the front power contact 201, normally named as a pre-charge power pin, is longer than the rear power contact 203, normally as +12V power pin. In other words, the front power contact 201 extends much closer to the front face 200 of the mating tongue 20 or a mating face of the second connector than the rear power contact 203. Referring particularly to FIG. 3, the two different-lengths power contacts 201 and 203 are arranged such that the first connector 1 and the second connector 2 mate at an initial position where the front power contact 201 is first electrically engaged by a corresponding terminal of the first connector 1 while the rear power contact 203 is not electrically engaged at that mating position. At that position, the signal ground contacts 206 and the power ground contacts 207 are also electrically engaged to effect the ground function. The first electrical engagement of the front power contact has the ability to handle the instantaneous inrush current through the front power contact 201, i.e. the pre-charge power pin.

Referring particularly to FIG. 4, the second connector 2 further includes two power ground contacts 207, associated with the two power contacts 201 and 203 and for the power contacts 201 and 203 to ground, located at another plane different from that of the power contacts 201 and 203, the signal contacts 205 and the signal ground contacts 206, which are commonly disposed on the same face of the mating tongue 20. In this embodiment, the two power ground contacts 207 are located below the face of the mating tongue 20. Two groups of ground contacts, including the signal ground contacts 206 associated with the signal contacts 205 and the power ground contacts 207 associated with the power contacts 201 and 203, are set to take on the respective currents on the signal contacts 205 and the power contacts 201, 203, which may avoid the current interference from the signal contacts 205 and the power contacts if one type of ground contacts, commonly belonging to the power contacts and the signal contacts, was applied.

While the two power contacts 201 and 203 being set on a same plane with the signal contacts 205 and the signal ground contacts 206 are preferred in this embodiment, the power contacts 201 and 203 can be also adopted to be set on another plane different from the signal contacts 205 and the signal ground contacts 206.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a mating portion defining a mating face;

a mating tongue exposed in said mating portion;

three type contacts including:

two first type contacts located on two opposite side regions of the mating tongue;

second and third types contacts disposed on a same face of the mating tongue and located between said two first type contacts; wherein one of said two first type contacts extends much closer to said mating face than the other of said two first contacts;

wherein said first type contacts are named as power contacts, the second type contacts as signal contacts, and the third type contacts as signal ground contacts for the signal contacts to ground;

wherein there are three said signal ground contacts located between said two power contacts, and two pairs of said signal contacts under a condition that each pair is located between the corresponding two adjacent signal ground contacts;

wherein said signal contacts, said signal ground contacts and said power contacts are disposed on a same face of the mating tongue; and two power ground contacts associated with said two power contacts, said two power ground contacts located at a plane different from that of said power contacts, said signal contacts and said signal ground contacts.

2. The electrical connector of claim 1, wherein said two power ground contacts located below said face of the mating tongue.

3. The electrical connector of claim 1, wherein said power contacts are widest among said three type contacts.

4. The electrical connector of claim 1, wherein said three types contacts are symmetrically arranged with one another with regard to a middle signal ground contact.

5. An electrical connector assembly, comprising:

a first connector having an insulative body, and a plurality of terminals assembled onto the insulative body;

a second connector for mating with the first connector, the second connector, comprising:

an insulative housing including a mating tongue; and a plurality of contacts assembled onto the insulative housing, comprising:

two power contacts being on two opposite side regions of the mating tongue;

two power ground contacts associated with said two power contacts; wherein the first connector and the second connector mate at a position where one of said two power contacts is electrically engaged by a corresponding terminal of the first connector while the other of said two power contacts is not electrically engaged;

wherein the second connector comprising three type contacts including three signal ground contacts located between said two power contacts and two pairs of signal contacts, each pair being located between the corresponding two adjacent signal ground contacts, said signal contacts, said signal ground contacts and said power contacts are disposed on a same face of the mating tongue;

wherein said two power ground contacts located at a plane different from that of said power contacts, said signal contacts and said signal ground contacts.

6. The electrical connector assembly of claim 5, wherein said two power ground contacts located below said face of the mating tongue.

7. The electrical connector of claim 5, wherein said power contacts are widest among said three type contacts.

8. The electrical connector of claim 5, wherein said three type contacts are symmetrically arranged with one another with regard to a middle signal ground contact.

9. An electrical connector comprising:

a mating port defining a mating face;

a mating tongue exposed in said mating portion;

four type contacts including:

two first type contacts located on two opposite side regions of the mating portion;

second and third type contacts disposed on a same face of the mating tongue and located between said two first contacts;

two fourth type contacts located on said two opposite side regions while being located at a different level with regard to the first type contacts;

wherein said first type contacts are named as power contacts, the second type contacts as signal contacts, the third type contacts as signal ground contacts for the signal contacts to ground, and the fourth type contacts as power ground contacts for the power contacts to ground;

wherein said two power contacts are located on the mating tongue and wider than said signal contacts and said signal ground contacts, under a condition that the signal ground contacts extend forwardly beyond the signal contacts and one of said power contacts extends forwardly longer than the other of said power contacts to be flush with the signal ground contacts while the other of said power contacts extending forwardly to be flush with the signal contacts.

10. The electrical connector of claim 9, wherein said two first type contacts are located on the mating tongue and thus essentially located in the same plane with the second and third type contacts, while essentially being aligned with the corresponding fourth type contacts in a direction perpendicular to said plane, respectively.

11. The electrical connector of claim 9, wherein all fourth type contacts are categorized with either a stationary manner or a deflectable manner under a condition that the first, second and third type contacts perform one of said stationary and deflectable manner while the fourth type contacts perform the other.

* * * * *